US009215922B2

(12) United States Patent
Delage et al.

(10) Patent No.: US 9,215,922 B2
(45) Date of Patent: Dec. 22, 2015

(54) DEVICE FOR PACKAGING A COSMETIC PRODUCT

(75) Inventors: Jean-François Delage, Clamart (FR); Lionel Drugeon, La Garenne Colombes (FR); Jean-Marc Lebrand, Pantin (FR)

(73) Assignee: L'OREAL, Paris (FR)

( * ) Notice: Subject to any disclaimer, the term of this patent is extended or adjusted under 35 U.S.C. 154(b) by 110 days.

(21) Appl. No.: 13/992,428

(22) PCT Filed: Dec. 1, 2011

(86) PCT No.: PCT/EP2011/071563

§ 371 (c)(1), (2), (4) Date: Sep. 5, 2013

(87) PCT Pub. No.: WO2012/076403

PCT Pub. Date: Jun. 14, 2012

(65) Prior Publication Data

US 2013/0343798 A1 Dec. 26, 2013

Related U.S. Application Data

(60) Provisional application No. 61/423,803, filed on Dec. 16, 2010.

(51) Int. Cl.

| | |
|---|---|
| ***A45D 34/04*** | (2006.01) |
| ***A45D 40/26*** | (2006.01) |
| ***A45D 40/00*** | (2006.01) |

(52) U.S. Cl.

CPC ..... *A45D 40/26* (2013.01); *A45D 40/0068* (2013.01); *A45D 40/265* (2013.01); (Continued)

(58) Field of Classification Search

CPC . A45D 34/045; A45D 34/046; A45D 40/265; A45D 40/267; A45D 2200/051

USPC ..... 401/126, 127; 215/273, 280, 287, 320; 220/212, 259.5, 326

See application file for complete search history.

(56) References Cited

U.S. PATENT DOCUMENTS

| | | | | |
|---|---|---|---|---|
| 7,503,718 | B2 * | 3/2009 | Hamada | 401/127 |
| 7,841,794 | B2 | 11/2010 | Salciarini et al. | |

(Continued)

FOREIGN PATENT DOCUMENTS

| | | |
|---|---|---|
| EP | 1 389 588 | 2/2004 |
| EP | 1 721 543 | 11/2006 |

(Continued)

OTHER PUBLICATIONS

International Search Report for International Patent Application No. PCT/EP2011/071560, dated Mar. 20, 2012.

(Continued)

*Primary Examiner* — David Walczak
*Assistant Examiner* — Joshua Wiljanen
(74) *Attorney, Agent, or Firm* — The Marbury Law Group, PLLC

(57) ABSTRACT

The invention relates to a device for packaging a cosmetic product, comprising a container (10) having an opening defined by a neck (12) of the container, and a cap (20) for closing the container (10). The cap (20) comprises a cover element (22), a closing-off element (40) for the opening, connected to the cover element (22), a spring member (39) located between the cover element (22) and the closing-off element (40), and a mechanism (30) for locking the cap on the container (10). According to the invention, the locking mechanism (30) comprises a means (25) for retaining the cover element on the container and a means (31) for actuating the retaining VIII means (25) so as to selectively enable the cover element (22) to move with respect to the container (10) from a locked position of the cover element to an unlocked position of the cover element (22) in which the cap (20) can be separated freely from the container (10).

9 Claims, 4 Drawing Sheets

(52) U.S. Cl.
CPC ..... *A45D34/045* (2013.01); *A45D 34/046* (2013.01); *A45D 40/267* (2013.01); *A45D 2200/051* (2013.01)

(56) References Cited

U.S. PATENT DOCUMENTS

| | | | | |
|---|---|---|---|---|
| 8,353,636 | B2 | 1/2013 | Drugeon et al. | |
| 2011/0000872 | A1* | 1/2011 | Aneas | 215/273 |
| 2012/0039659 | A1 | 2/2012 | Sanchez | |
| 2012/0175336 | A1* | 7/2012 | Miller et al. | 215/216 |
| 2013/0343800 | A1* | 12/2013 | Drugeon et al. | 401/126 |

FOREIGN PATENT DOCUMENTS

| | | |
|---|---|---|
| EP | 1 800 561 | 6/2007 |
| EP | 2 220 960 | 8/2010 |
| FR | 2 932 067 | 12/2009 |
| JP | 61 019539 | 2/1986 |
| WO | 2010/106235 | 9/2010 |
| WO | 2012/076402 | 6/2012 |

OTHER PUBLICATIONS

International Search Report for corresponding International Patent Application No. PCT/EP2011/071563, dated Mar. 20, 2012.

* cited by examiner

DEVICE FOR PACKAGING A COSMETIC PRODUCT

This is a national stage application of PCT/EP2011/071563, filed internationally on Dec. 1, 2011, which claims priority to U.S. Provisional Application No. 61/423,803, filed on Dec. 16, 2010, as well as French Application FR 1060305, filed on Dec. 9, 2010, the entire contents each of which is incorporated by reference herein.

The present invention relates to a device for packaging a cosmetic product.

The invention relates more particularly to a device for packaging a cosmetic product provided with an opening mechanism having an actuating means.

The expression "cosmetic product" is understood to mean any composition as defined in Council Directive 93/35/EEC of 14 Jun. 1993.

A cosmetic product is generally packaged in a container closed by a cap screwed onto this container. Thus, pots that contain for example a care cream and have a closing lid screwed onto the pot are known. Also known are packaging devices that comprise a container and a cap, comprising an applicator fixed to the cap and extending into the container, the cap thus serving as a member for grasping the applicator. This is the case particularly for mascara.

A drawback with this type of packaging is that the user needs to use both hands, such that the container is held in one hand and the cap is unscrewed with the other hand. This can be a problem for disabled persons or persons whose motor functions are impaired, particularly on account of a condition such as arthritis, for example.

In addition, the screw closure imposes a circular shape on the parts to be joined together, thereby constraining the design and/or limiting the possibilities of developing these devices.

Finally, this type of packaging device is rendered impermeable by seal compression along the movement axis of the cap with respect to the container, and this impermeability depends on the screwing force. Thus, during unscrewing, impermeability is no longer guaranteed.

Document EP1721543 proposes a device for packaging a cosmetic product, comprising both an applicator element intended to contain the product and also a tubular element forming a cap for the applicator element. This cap comprises a part that slides in the tubular element and is connected to the latter by an elastically compressible device. Thus, the sliding part may take up two positions such that the user can grasp the end of the applicator element or such that the end of the applicator element is positioned entirely in the cap.

However, the applicator element is friction-fitted in the tubular storage element. Therefore, this device does not have a retaining means or a means for actuating the retaining means so as to selectively enable the applicator element to move with respect to the cap. A drawback with such a device is that, with wear, the friction between the applicator element and the sliding part is no longer sufficient to hold these two elements together.

Document EP2220960 proposes a device for packaging a cosmetic product, comprising a body for holding the cosmetic product and a cover that forms a cap for the holding body. This cap comprises a body retaining assembly that can be moved under the action of a pushing member that is able to move with respect to the cover. An elastic urging member is interposed between the pushing member and the retaining assembly. Thus, the retaining assembly may take up two positions such that the user can grasp the end of the holding body or such that the end of the holding body is positioned entirely in the cap.

However, the holding body is friction-fitted in the retaining assembly. As in the preceding document, a drawback with such a device is that, with wear, the friction between the applicator element and the sliding part is no longer sufficient to hold these two elements together.

Document WO2010106235 proposes a device comprising a container for packaging a cosmetic product surrounded by a protective element. The opening in the container is closed by a closing-off member carrying an applicator. The protective element comprises a means for retaining the container and closing-off member assembly in relation to the protective element. A means for actuating the retaining means inactivates the retaining means in order to detach the container and closing-off member assembly from the protective element. This assembly is moved with respect to the protective element by means of a return element positioned between the container and the protective element. The return element also makes it possible to maintain sufficient impermeability when the device is in the locked position.

This device is relatively complex and necessitates the use of a protective element that makes it more time consuming and more expensive to assemble the device.

Moreover, in this device, the closing-off member is separated from the protective element and thus serves as a grasping member. The grasping member can thus be contaminated, causing the user's fingers to be soiled.

Finally, when the device is in the unlocked position, impermeability between the closing-off member and the container is no longer ensured as well as it is in the locked position, since the axial force of the return means is no longer exerted between these two elements, and this can lead to spillages of product if the device is unlocked accidentally.

The object of the present invention is thus to provide an improved device for packaging a cosmetic product in order to alleviate the abovementioned drawbacks.

To this end, the invention provides a device for packaging a cosmetic product, comprising a container having an opening defined by a neck of the container, and a cap for closing the container. The cap comprises a cover element, a closing-off element for the opening, connected to the cover element, a spring member located between the cover element and the closing-off element, and a mechanism for locking the cap on the container.

According to the invention, the locking mechanism comprises a means for retaining the cover element on the container and a means for actuating the retaining means so as to selectively enable the cover element to move with respect to the container from a locked position of the cover element to an unlocked position of the cover element in which the cap can be separated freely from the container.

The invention advantageously provides a simple packaging device comprising an unlocking mechanism which is easily activated.

According to further features of the invention, the cover element may be moved from the locked position to the unlocked position by moving purely in translation with respect to the container along the opening axis of said container, thereby making it possible for packaging elements having a non-circular cross section to be used.

The closing-off element may be fixed with respect to the container during the movement of the cover element from the locked position to the unlocked position. This feature makes it possible advantageously to ensure impermeability even when the stopper is in the unlocked position.

The device may comprise a seal able to engage with the closing-off element and the neck of the container, the seal being in contact with the closing-off element and the neck of the container in the unlocked position of the cap.

The contact between the seal and the neck of the container and/or between the seal and the closing-off element may be radial with respect to the movement axis of the cover element from the locked position to the unlocked position.

The seal may be mounted in a fixed manner on the closing-off element.

The closing-off element may comprise an applicator which extends from the cap into the container, and the seal may then be an applicator wiper mounted in a fixed manner on the neck of the container.

The neck of the container may comprise a catching means that engages with the retaining means of the locking mechanism.

The cover element may comprise an insert and the retaining means may then be supported by said insert.

The insert may comprise a means for limiting the movement path of the cover element with respect to the closing-off element while the cover element passes from the locked position to the unlocked position.

The actuating means may be a pushbutton which is able to move in translation along the opening axis of the container.

The invention will be understood better from reading the following description of non-limiting examples of the implementation thereof with reference to the appended drawings, in which.

In the following description, the terms outer, external and outside are used to qualify orientations which extend radially from the axis X-X of the opening of the container towards the outside of the device, contrary to the terms inner, internal and inside.

Figure 1:
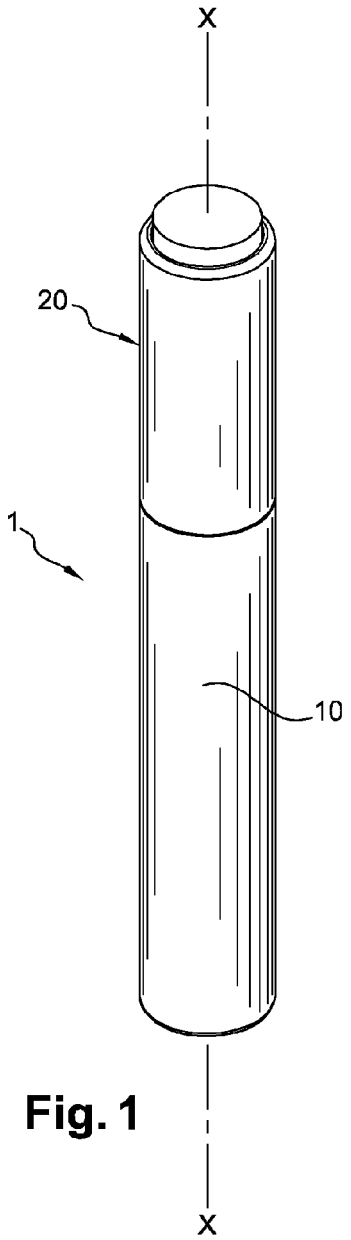
FIG. 1 shows an example of a packaging device according to the invention.
Figure 2:
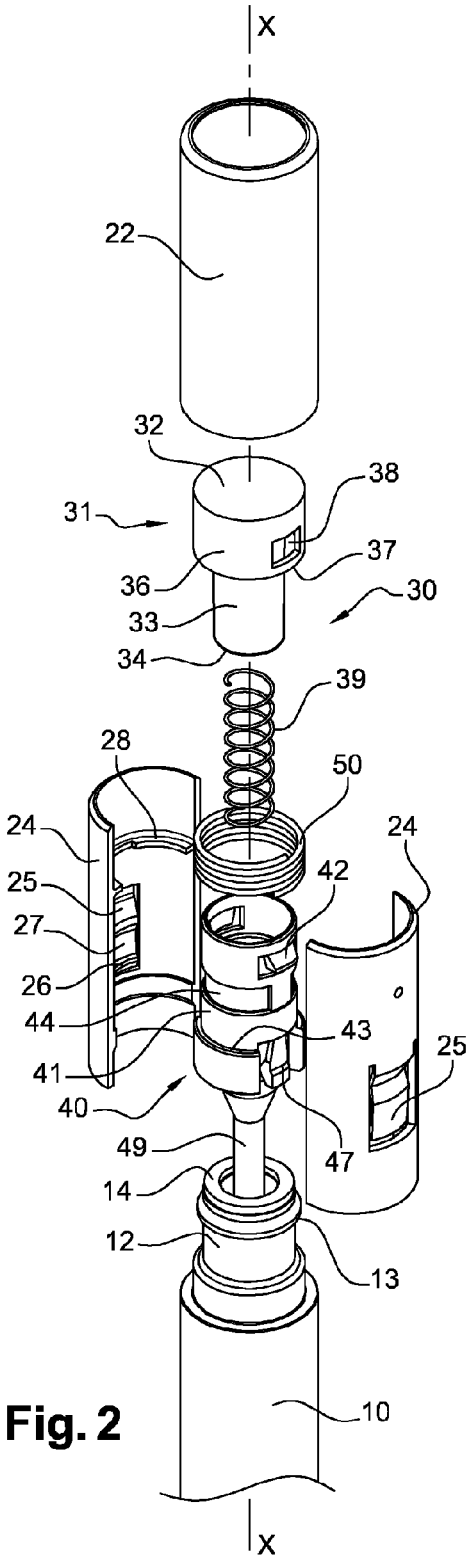
FIG. 2 shows an exploded view of the device from FIG. 1.

With reference to FIGS. 1 and 2, a device 1 for packaging a cosmetic product comprises a container 10 for containing said product and a cap 20 for closing the container 10.

In this example, the device 1 is a device for packaging and applying mascara, but the invention is not limited to this type of packaging. The invention may also relate to devices for packaging other cosmetic products such as nail varnishes, lipsticks, lip glosses or care products, for example.

In this example, the container 10 and the cap 20 of the device 1 have circular cross sections. However, other cross sections are conceivable, such as polygonal, ovoid, non-circular or other cross sections.

The container 10 is a hollow body that is closed at one end by an end wall, and is open at the other end. The opening in the container 10 is defined by a neck 12 that extends from a shoulder of the container 10. In this example, the neck 12 has a circular cross section, but it could have a different one. The axis of the opening is a longitudinal axis X-X which is also, in this example, the axis along which the hollow body forming the container 10 mainly extends.

The neck 12 has a catching means 13 located between the shoulder of the container 10 and the upper rim of the neck 12.

This catching means 13 is for example an annular bulge that projects radially from the outer wall of the neck 12. The upper face of the bulge, said upper face being directed towards the free end of the neck 12, forms a frustoconical portion which flares towards the bottom, whereas the lower face of the bulge, said lower face being directed towards the end wall of the container 10, extends in a transverse plane to the longitudinal axis X-X.

The container 10 may for example be made of glass, metal or plastic.

A seal 14 is fixed in the opening defined by the neck 12 of the container 10. In the case of mascara, the seal 14 also provides the function of wiping an applicator member. To this end, the seal may also be called a wiper.

The seal 14 is approximately tubular and is engaged at least partly with a tight fit against the inner wall of the neck 12 so as to form circular impermeability between the seal 14 and the neck 12 of the container 10. The seal 14 may comprise an upper edge intended to come into axial contact with the upper peripheral rim of the neck 12.

In addition, the seal 14 may comprise, close to its upper end, an external annular boss which is engaged in an internal annular groove in the neck 12 in order to axially retain the seal 14 in the neck 12.

In order to provide the wiping function, the lower end of the seal 14 is formed with a frustoconical wall which is flared from bottom to top so as to define a through-orifice towards the inside of the container, said orifice being narrower than the opening in the neck 12.

The cap 20 comprises a cover element 22, a locking mechanism 30 for keeping the cap 20 on the container 10, and a closing-off element 40 for the opening in the container 10.

The cover element 22 is a tubular element that extends along the longitudinal axis X-X. The cover element is open at each end. The downwardly directed lower end of the device 1 is intended to face the shoulder of the container.

The cover element serves as an element for grasping the cap 20, in particular in order to separate it from the container, as will be explained hereinbelow.

The mechanism 30 for locking the cap 20 on the container 10 comprises a means 25 for retaining the cover element 22 on the container 10 and a means 31 for actuating the retaining means 25.

The retaining means 25 is supported by an insert 24 fixed in a non-removable manner in the cap 20. The insert 24 is a tubular hollow body fitted into the cap 20.

The insert 24 may be produced in one piece; however, in this example, the insert 24 is formed by two semi-cylindrical shells such that the cross section of the insert 24, when the two shells are joined together, is approximately circular.

The cross section of the insert 24 is not limited to a circular cross section but may have any other shape matched to the cross section of the cap 20.

The insert 24 may be fixed in a non-removable manner in the cap 20 by any appropriate means, for example by adhesive bonding, with a tight fit or by snap-fastening.

The insert 24 may be produced for example from metal, or from plastic, such as polyoxymethylene (POM) or acrylonitrile butadiene styrene (ABS).

The lower part of the insert 24, that is to say the part closest to the open end of the cap 20, is designed to be able to be fitted on the neck 12 of the container 10 while the cap 20 is positioned on the container 10. To this end, the inside diameter of the lower part of the insert 24 is approximately the same as the outside diameter of the base of the neck 12.

The retaining means 25 is a flexible tongue which is in the form of a tab delimited in the wall of the insert 24 by a U-shaped opening. Thus, the tongue extends longitudinally and has an upper end connected to the insert 24 and free lower end.

The flexible tongue has an offset towards the inside of the cap 20 and thus extends, in the rest position, in a manner set back from the inner wall of the cover element 22 such that it can be moved radially towards said inner wall of the cover element 22.

The inner face of the flexible tongue has a boss that forms a catch 26 intended to engage with the catching means 13 on the neck 12 of the container 10 in the locked position of the cap 20.

Thus, the upper face of the boss forming the catch 26 extends in a transverse plane to the longitudinal axis X-X in order to come into abutment against the lower face of the catching means 13 in the locked position of the cap 20 on the container 10, in which the tongue is in the rest position.

The lower face of the boss extends in an inclined plane and can engage with the upper face of the catching means 13 so as to distance the flexible tongue from its rest position while the cap 20 is being locked on the container 10.

The retaining means 25 likewise comprises an actuating portion 27 of the catch 26 in order to release the retaining means of the catching means 13 on the neck 12 of the container 10.

This actuating portion 27 is formed by a portion of the inner face of the tongue positioned above the catch 26.

In this example, each shell of the insert 24 has such a retaining means 25 such that the cap 20 comprises two tongues which are symmetrically opposite with respect to the longitudinal axis X-X.

The inner wall of the insert 24 likewise comprises an annular abutment 28 consisting of a rib that extends in a transverse plane to the longitudinal axis X-X towards the inside of the insert 24. This annular abutment 28 is located between the retaining means 25 and the upper end of the insert 24.

The actuating means 31 consists of a pushbutton that slides along the axis X-X in the cap 20.

The actuating means 31 comprises an upper plate 32 that forms an actuating surface for the pushbutton and extends approximately along a transverse plane to the longitudinal axis X-X in the opening in the upper end of the cover element 22. At rest, this actuating surface for the pushbutton is flush with or projects from the upper end of the cover element 22.

The actuating means 31 likewise comprises an inner skirt 33 that forms a cylindrical wall extending axially into the cap 20 from the upper plate 32 at a distance from the edge of this plate 32 as far as a free actuating edge 34.

The actuating means 31 also comprises an outer skirt 36 that forms a cylindrical wall extending axially into the cap 20 from the edge of the upper plate 32 as far as a free abutment edge 37. In this example, the length of the outer skirt 36 is less than the length of the inner skirt 33.

The outer skirt 36 has two windows 38 passing through the wall of the outer skirt 36. The two windows 38 are symmetrically opposite with respect to the longitudinal axis X-X of the device 1.

A closing-off element 40 for the opening in the container 10 is mounted in a sliding manner with respect to the insert 24 and thus with respect to the cap 20. The closing-off element is produced for example from plastic, such as polyoxymethylene (POM) or polypropylene (PP).

To this end, the closing-off element 40 comprises an upper part 41 forming an approximately cylindrical sleeve that extends longitudinally from a base forming a closing-off surface 45 for the opening in the container 10.

The diameter of the sleeve of the upper part 41 is greater than the outside diameter of the inner skirt 33 of the actuating means 31 and less than the diameter of the outer skirt 36, such that the wall forming the sleeve is positioned between the inner skirt 33 and the outer skirt 36 of the actuating means 31.

A return member 39, for example a helical compression spring, is located between the closing-off element 40 and the actuating means 31 so as to generate a force that tends to push these two elements away from one another along the longitudinal axis X-X. More precisely, one end of the return member 39 is positioned inside the sleeve of the upper part 41, bearing against the base of the closing-off element 40, and the other end is positioned inside the inner skirt 33, bearing against the lower face of the upper plate 32 of the actuating means 31.

The upper end of the outer wall of the sleeve has two diametrically opposite protrusions 42 that extend radially. Each protrusion 42 is inserted into a window 38 in the outer skirt 36 of the actuating means 31 such that it can move in this window 38 along an axis parallel to the axis X-X.

Thus, the protrusions 42 can come into abutment against the top and bottom edges of the windows 38 in the actuating means 31, thereby making it possible to limit the axial movement, brought about by the return means 39, of the actuating means 31 with respect to the closing-off element 40.

The outer wall of the sleeve of the closing-off element 40 likewise comprises a narrowing 44. The outside diameter of the sleeve at the narrowing 44 is approximately the same as the diameter of the insert 24 taken at the inner end of the annular stop 28. The annular stop 28 of the insert 24 thus moves along the narrowing 44 and can come into abutment against the upper edge or against the lower edge of the narrowing 44.

The outer wall of the sleeve of the closing-off element 40 also comprises a stop shoulder 43 forming an annular surface that is directed towards the upper end of the device 1. The diameter of the sleeve at the end of the shoulder 43 is substantially greater than the outside diameter of the sleeve such that the annular surface faces the lower face of the annular stop 28 of the insert 24.

The upper part 41 of the closing-off element 40 also comprises flexible actuating tabs 47. The actuating tabs 47 are formed in the wall of the sleeve of the upper part 41 and are delimited from this wall by a U-shaped opening. Thus, the actuating tabs 47 extend longitudinally and have an upper end connected to the sleeve of the upper part 41 and a free lower end.

In this example, the closing-off element 40 comprises two actuating tabs 47 which are diametrically opposite on the sleeve such as to be able to engage with the actuating portions 27 of the two retaining means 25 of the insert 24.

Each actuating tab 47 has at its free end a boss 48 that projects from the inner face of the actuating tab 47 and has an inclined upper face. This boss 48 is able to engage with the actuating edge 34 of the inner skirt 33 of the actuating means 31. More precisely, the axial movement of the inner skirt 33 in the sleeve of the upper part 41 enables the actuating edge 34 to come into contact with the boss 48 and to cause the flexible actuating tab 47 to move radially outwards.

The closing-off surface 45 of the closing-off element 40 forms a cylinder that is positioned in contact with the inner faces of the tubular portion of the seal 14.

Figure 8:
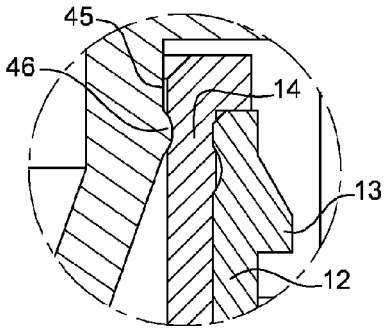
FIGS. 8 and 9 show detail views of the seal according to a first and a second variant.
Figure 9:
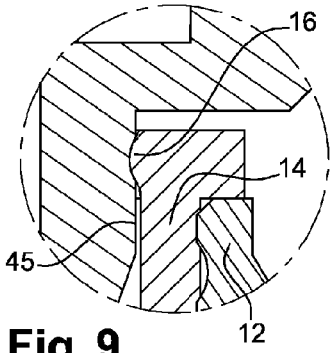

In order to obtain optimum contact to form impermeability at the neck of the container 10, the closing-off surface 45 may comprise an annular bead 46 on its periphery, as is shown in FIG. 8. A variant is shown in FIG. 9, in which the closing-off surface 45 does not have a bead but in which the inner face of the seal 14 has an annular bulge 16 that deforms in contact with the closing-off element 40. In any case, contact between each element that produces impermeability takes place radially with respect to the longitudinal axis X-X.

The impermeability thus obtained is impermeability to gas and to liquid. More precisely, the device remains impermeable, that is to say that no leakage of product to the outside of the device is observable, when the device is placed in the locked position in a vacuum bell in order to be subjected to reduced pressure while the pressure inside the container 10 containing cosmetic product, such as mascara, is approximately equal to the atmospheric pressure of around 1 bar. The impermeability of the device is preserved down to a pressure in the bell, outside the device, of less than 0.3 bar, or even less than 0.25 bar, for example 0.2 bar.

Moreover, in the unlocked position, the device remains impermeable at atmospheric pressure as long as the closing-off element 40 is not removed from the neck of the container 10. The force for removing the closing-off element 40 from the neck of the container 10 is greater than the weight of the container 10 filled with product P. For example, this removing force is greater than 1 Newton or even greater than 2 Newtons.

In this example, a wand 49 extends longitudinally along the axis X-X starting from the closing-off surface 45 of the closing-off element 40. The end of the wand 49 is provided with an applicator element (not shown in the figures), for example of mascara brush type or of the lip gloss applicator type. Thus, when the closing-off element 40 closes the opening in the container 10, the wand 49 and the applicator element are dipped into the container 10. The cap 20 and the closing-off element 40 thus form a cosmetic product applicator.

The device 1 comprises a spring member 50 located between the cap 20 and the closing-off element 40 so as to generate a force that tends to push these two elements away from one another along the longitudinal axis X-X. More precisely, the spring member 50 is located between the insert 24 fixed to the cap 20 and the closing-off element 40.

In this example, the spring member 50 is a helical spring mounted in compression. The lower end of the spring member 50 is positioned in abutment along a longitudinal axis against the stop shoulder 43 of the closing-off element 40. The upper end of the spring member 50 is positioned in abutment along a longitudinal axis against the annular stop 28 of the insert 24.

The invention is not limited to a spring member formed by a helical spring, but other types of spring member may be used, for example elastic tongues formed integrally with the closing-off element 40 or with the insert 24.

The manner in which the device 1 functions will now be described with reference to FIGS. 3 to 7.

Figures 3, 4, 5, 6, 7:
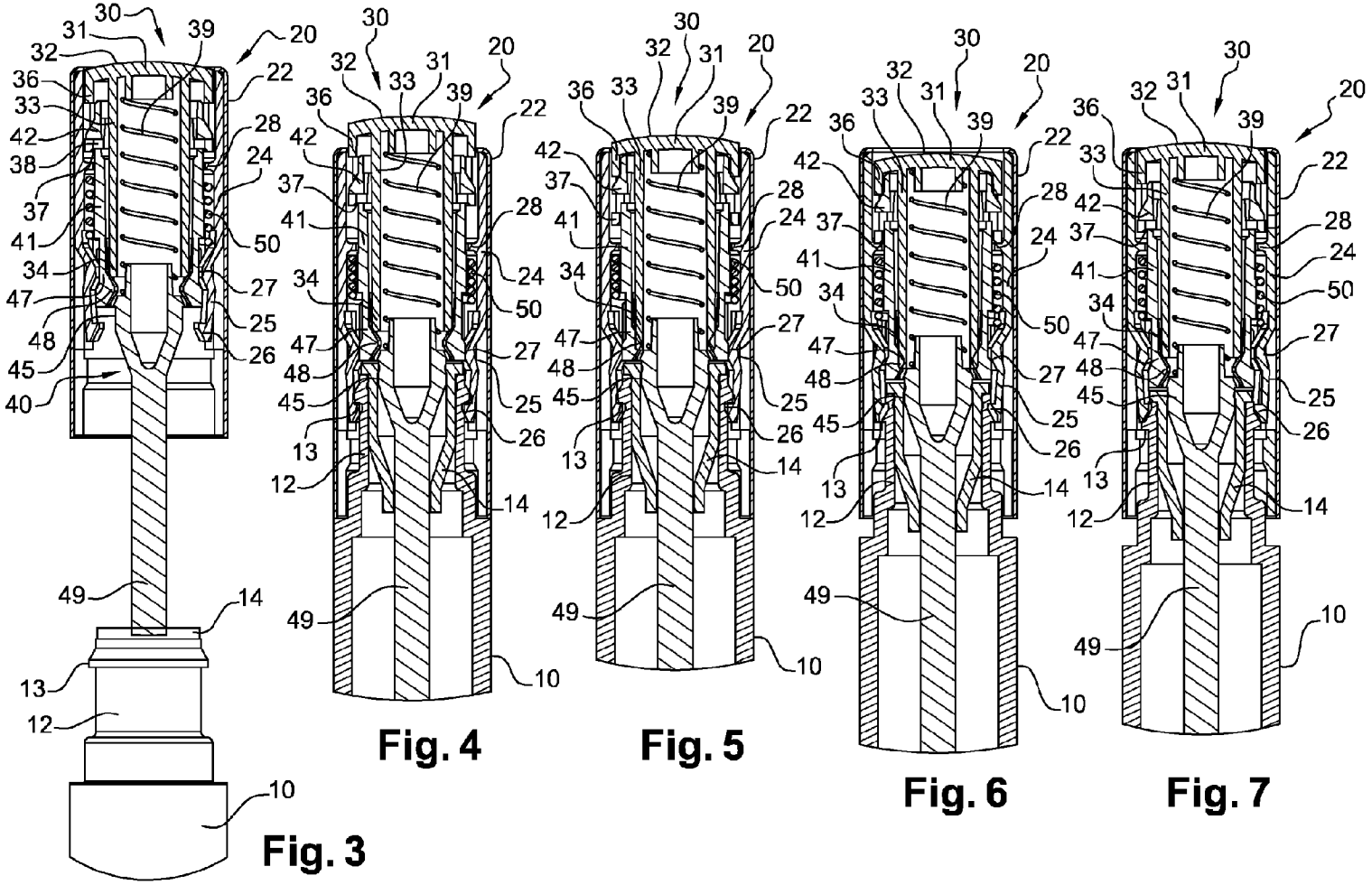
FIGS. 3 to 7 show sectional views of the cap of the device from FIG. 1, in various positions of the locking mechanism.

With reference to FIG. 3, the cap 20 of the device 1 is in the position separated from the container 10.

In this separated position, the insert 24 slides freely with respect to the closing-off element 40. However, the spring member 50 exerts a force that tends to push these two elements away from one another along the longitudinal axis X-X. In order to avoid the insert 24 separating from the closing-off element 40, the movement path of the insert is limited by the annular stop 28 of the insert 24, which comes into contact with the upper edge of the narrowing 44 of the closing-off element 40. Although the spacing between the insert 24 and the closing-off element 40 is then at a maximum, the spring member 50 is still stressed so as to avoid relative play between the various parts of this mechanism.

In this separated position, the actuating means 31 also slides with respect to the closing-off element 40. However, the return member 39 exerts a force that tends to push these two elements away from one another along the longitudinal axis X-X. In order to avoid the actuating means 31 separating from the closing-off element 40, the movement path of the actuating means 31 is limited by the protrusions 42 on the closing-off element 40, which come into contact with the lower edge of the windows 38 in the actuating element 31, in which windows the protrusions are engaged. Similarly, although the spacing between the actuating means 31 and the closing-off element 40 is then at a maximum, the return member 39 is still stressed so as to avoid relative play between the various parts of this mechanism. The actuating surface of the upper plate 32 of the actuating means 31 then extends into the opening and is flush with the upper end of the cover means 22.

In an intermediate position, which is not shown, when the user joins the cap 20 to the container 10, the lower face of the catches 26 on the insert 24 come into contact with the upper face of the catching means 13 on the neck 12 of the container 10 so as to space apart the flexible retaining means 25 of the insert 24 before these retaining means 25 return into the rest position in order to lock the cap 20 on the container 10.

With reference to FIG. 4, the cap 20 of the device 1 is in the locked position on the container 10.

In this locked position, the closing-off surface 45 of the closing-off element 40 is positioned in the opening in the container 10 so as to be in contact with the seal 14. The upper part 41 of the closing-off element 40 may then be in axial abutment against the upper peripheral rim of the neck 12.

In this locked position, the insert 24 is fixed on the neck 12 of the container 10. For this purpose, the upper face of the catches 26 on the insert 24 is in contact with the lower face of the catching means 13 on the neck 12 of the container 10 so as to prevent the insert 24 from moving axially upwards. The axial downward movement of the insert is likewise limited by the shoulder of the container 10 on which the lower part of the insert 24 is positioned in abutment.

The annular stop 28 on the insert 24 is then in contact with the lower edge of the narrowing 44 of the closing-off element 40.

The spring member 50 is compressed and exerts a force that tends to engage the closing-off element 40 in the opening in the container 10.

In this locked position, the actuating tabs 47 of the closing-off element are at rest facing the actuating portions 27 of the retaining means 25, which are likewise at rest.

The relative position between the actuating means 31 and the closing-off element 40 is the same as in the above-described separated position. The return member 39 exerts a force that tends to push these two elements away from one another and the movement path of the actuating means 31 is limited by the protrusions 42 on the closing-off element 40 which are in contact with the lower edge of the windows 38 in the actuating means 31.

The actuating surface of the upper plate 32 of the actuating means 31 then extends into the opening and projects from the upper end of the cover means 22.

With reference to FIG. 5, the locking mechanism 30 is in a first intermediate position when the user exerts a pressure on the actuating means 31 while the cap 20 of the device 1 is in a locked position.

The actuating means 31 is then moved in translation with respect to the closing-off element 40, which remains fixed with respect to the container 10. However, the relative movement between the actuating means 31 and the closing-off element 40 is limited by the protrusions 42 on the closing-off element 40 which come into contact with the upper edge of the windows 38 in the actuating means 31. The return member 39 is thus compressed by the movement of the actuating means 31.

During this movement, the actuating edge 34 of the inner skirt 33 of the actuating means 31 comes into contact with the boss 48 on each actuating tab 47 and causes the radial movement of the flexible actuating tab 47 towards the outside. Each actuating tab 47 then comes into contact with the corresponding retaining means 25. The retaining means are then likewise moved radially, releasing the catches 26 from the catching means 13 on the neck 12 of the container 10.

With reference to FIG. 6, the locking mechanism 30 is in a second intermediate position when the user maintains the pressure on the actuating means 31 once the retaining means 25 have been released from the catching means 13.

The relative position of the actuating means 31 with respect to the closing-off element 40 remains unchanged with respect to the preceding first intermediate position. The closing-off element 40 remains fixed with respect to the container 10.

The insert 24 is then no longer retained on the container 10. The insert 24 moves by moving purely in translation with respect to the closing-off element 40 under the effect of the spring member 50, which exerts a force that tends to push the insert 24 and the closing-off element 40 away from one another. The movement path of the insert 24 is limited by the annular stop 28 of the insert 24, which comes into contact with the abutment edge 37 of the outer skirt 36 of the actuating means 31 and then, when the pressure on the actuating means is released, with the upper edge of the narrowing 44 of the closing-off element 40, as in the separated position of the device 1.

The retaining means 25 move with respect to the actuating tabs 47. The retaining means 25 may remain spaced apart radially. The retaining means 25 may likewise comprise a depression in which the spaced-apart actuating tabs 47 may be housed in order that the retaining means 25 return to their rest position.

The actuating surface of the upper plate 32 of the actuating means 31 then extends into the opening below the upper end of the cover means 22.

With reference to FIG. 7, the cap 20 of the device 1 is in a predetermined unlocked position.

In this position, the pressure exerted by the user on the actuating means 31 is then released.

The insert 24 has moved freely with respect to the closing-off element 40 under the action of the spring member 50. The annular stop 28 on the insert 24 is then in contact with the upper edge of the narrowing 44 of the closing-off element 40.

In this unlocked position, the actuating means 31 also slides with respect to the closing-off element 40 under the action of the return member 39. The protrusions 42 on the closing-off element 40 are then in contact with the lower edge of the windows 38 in the actuating means 31.

The actuating edge 34 of the inner skirt 33 of the actuating means 31 is no longer in contact with the boss 48 on each flexible actuating tab 47. Each actuating tab 47 thus returns to the rest position.

The actuating surface of the upper plate 32 of the actuating means 31 then extends into the opening and is flush with the upper end of the cover means 22.

This relative position of the insert 24, of the actuating means 31 and of the closing-off element 40 is thus identical to that in FIG. 3.

In this unlocked position, the closing-off element 40 remains in position in the opening in the container and the radial contact between the seal 14 and the closing-off element 40 is preserved, making it possible to maintain impermeability even in the unlocked position.

The user can then freely remove the cap 20 by exerting an axial pulling force greater than the frictional force exerted by the closing-off element 40 on the seal 14. The cap 20 is then separated from the container as in FIG. 3.

In a variant which is not shown, the actuating means can act directly on the retaining means in order to release the latter without passing via an intermediate element such as the actuating tab of the closing-off element in the preceding example.

Figure 10:
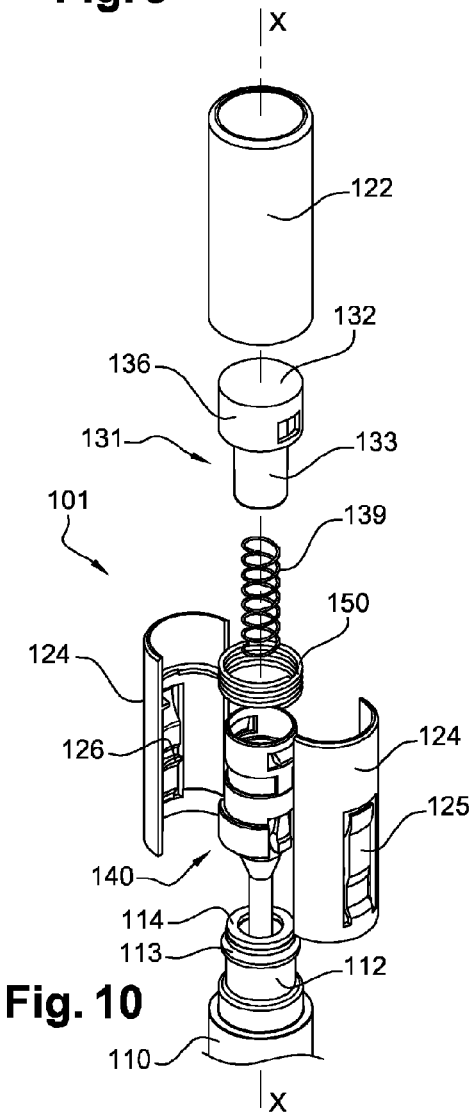
FIG. 10 shows an exploded view of a variant of the packaging device from FIG. 1.
Figure 11:
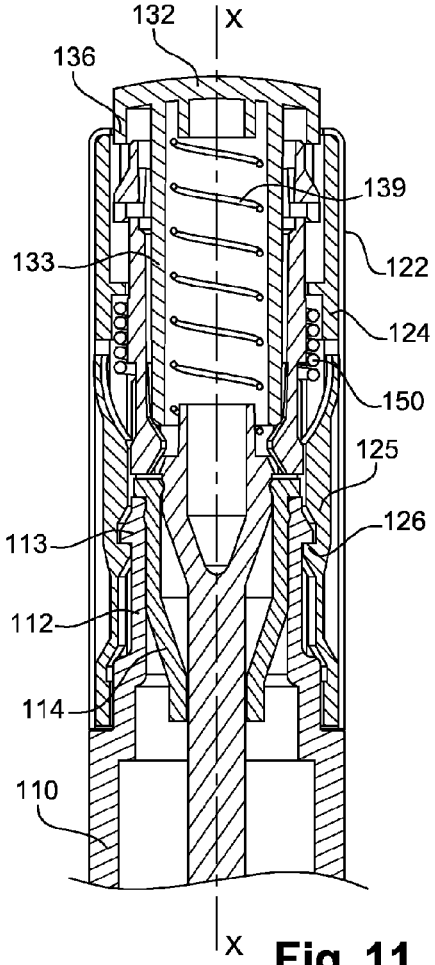
FIG. 11 shows a sectional view of the cap of the device from FIG. 10, in the locked position.

A variant of the above-described device is shown in FIGS. 10 and 11. Elements similar to the first example have the same references increased by one hundred.

The packaging device 101 of this variant is similar to the preceding device 1. However, this device 101 provides an insert 124, the retaining means 125 of which are formed by elastic tongues which are reversed compared with those of the preceding device 1.

Thus, each flexible tongue is delimited in the wall of the insert 124 by an inverted U-shaped opening. Thus, each tongue extends longitudinally and has a lower end connected to the insert 124, and a free upper end. The way in which these retaining means 125 function is identical to that of the retaining means 25 in the preceding variant.

However, this type of retaining means 125 advantageously affords better functioning over time, since the wear of the tongues causing an increase in their elasticity has less of an impact on the locking of the cap 120 on the container 110.

This is because each catch 126 is, in this case, located closer to the end connected to the wall of the insert 124, the increase in elasticity having less of an impact here than at the free end.

Figure 12:
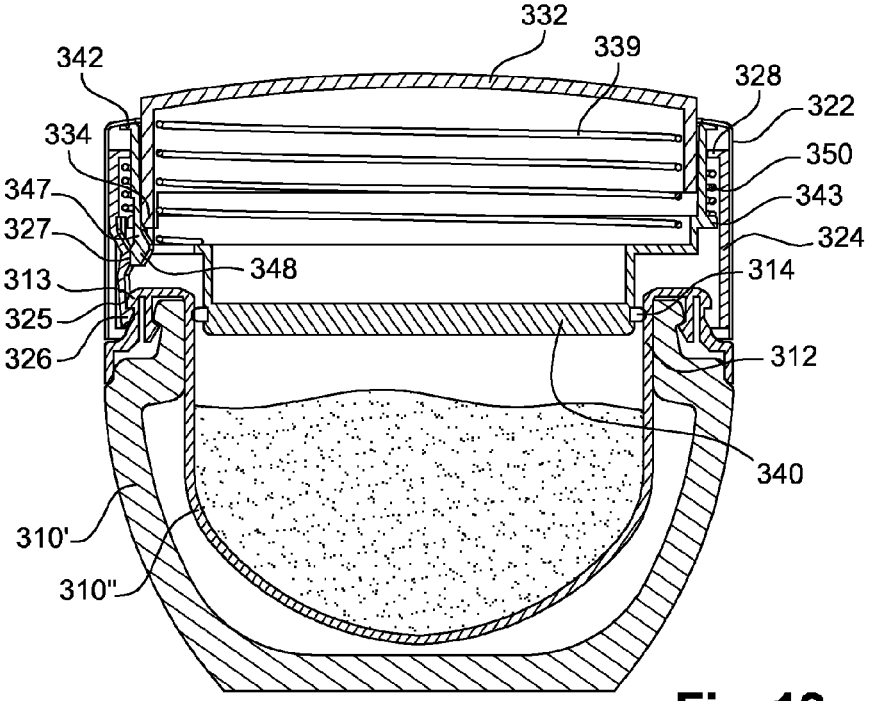
FIGS. 12 and 13 show sectional views of another variant of the packaging device according to the invention, in the locked position and the unlocked position, respectively.
Figure 13:
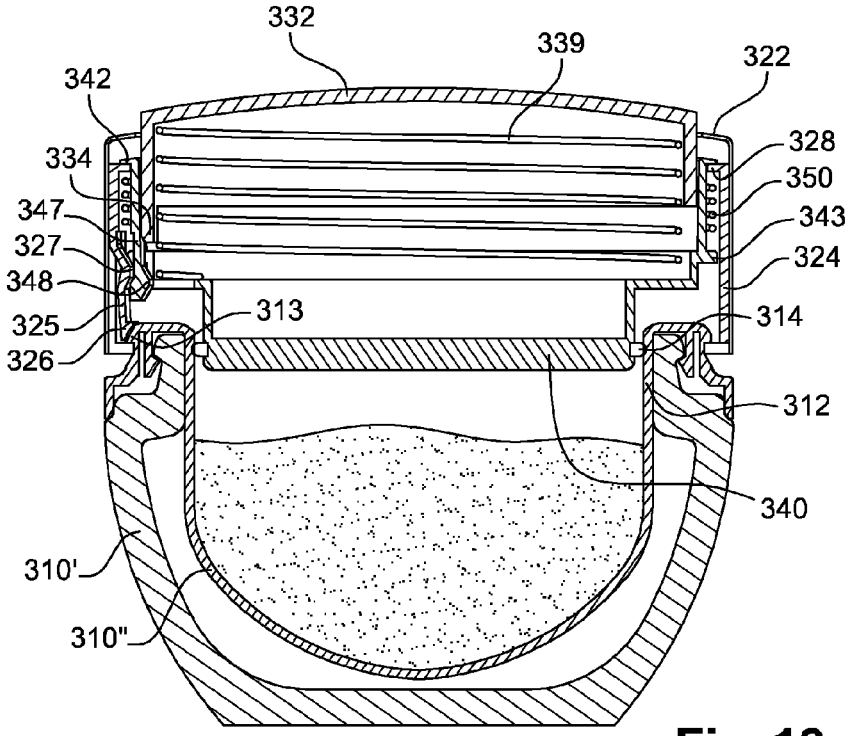

A variant of the device of the invention is shown in FIGS. 12 and 13. Elements similar to the first example have the same references increased by three hundred.

This variant provides a device 301 for packaging a care product such as a cream.

The device 301 comprises a container, a locking mechanism 330 and a cap 320. In this variant, the container is in the form of a pot and the cap does not have an applicator element connected to the closing-off element. For reasons of aesthetics and/or ease of manufacturing, the container is produced in two parts, namely an outer shell 310' and an inner shell 310" snap-fastened onto the outer shell.

The inner shell 310" is for example produced from plastic, while the outer shell 310' is made of glass.

The opening in the container is defined by a circular neck 312 formed in part by the inner shell 310".

The neck 312 has a catching means 313, for example an annular bulge that projects radially from the outer wall of the neck 312.

As in the preceding examples, the cap comprises a cover element 322, a locking mechanism for keeping the cap on the container, and a closing-off element 340 for the opening in the container.

The mechanism for locking the cap on the container comprises a retaining means 325 and a means for actuating the retaining means 325.

The retaining means 325 is supported by an insert 324 fixed in a non-removable manner in the cover element 322.

The retaining means 325 is a flexible tongue which is in the form of a tab delimited in the wall of the insert 324 by a U-shaped opening. Thus, the tongue extends longitudinally and has an upper end connected to the insert 324 and free lower end. In this example, the device comprises three tongues distributed angularly every 120° around the insert 324.

The inner face of the flexible tongue has a boss that forms a catch 326 intended to engage with the catching means 313 in the locked position of the cap.

The retaining means 325 likewise comprises an actuating portion 327 of the catch 326 in order to release the retaining means of the catching means 313.

The inner wall of the insert 324 likewise comprises an annular stop 328.

The actuating means consists of a pushbutton that slides along the axis of the opening with respect to the insert 324.

The pushbutton has an actuating surface formed by an upper plate 332 and a skirt that extends from the upper plate 332 to a free actuating edge 334.

A closing-off element 340 for the opening in the container is mounted in a sliding manner with respect to the insert 324 and thus with respect to the cap.

To this end, the closing-off element 340 comprises an upper part forming an approximately cylindrical sleeve that extends longitudinally from a base forming a closing-off surface for the opening in the container.

A return member 339, for example a helical compression spring, is located between the closing-off element 340 and the actuating means so as to generate a force that tends to push these two elements away from one another.

The upper end of the closing-off element 340 comprises a lip 342 that extends radially outwards. This lip 342 is able to move between the upper end of the insert 324 and a projection on the cover element 322, thus making it possible to limit the axial movement brought about by the return means 339.

The outer wall of the closing-off element 340 also comprises a stop shoulder 343 forming an annular surface that is directed towards the upper end of the device.

The annular stop 328 of the insert 324 is positioned between the stop shoulder 343 and the lip 342 and between these two elements.

The closing-off element 340 also comprises flexible actuating tabs 347. In this example, the closing-off element 340 comprises an actuating tab 347 for each retaining means 325 of the insert 324.

Each actuating tab 347 has at its free end a boss 348 that projects from the inner face of the actuating tab 347 in order to engage with the actuating edge 334 of the actuating means.

The closing-off surface of the closing-off element 340 forms a cylindrical plate, the edge of which has a radially open groove. This groove receives a seal 314, which is for example an O-ring seal. This seal 314 is able to engage in the opening in the container in contact with the inner wall of the neck 312 so as to produce impermeability between the closing-off element 340 and the neck 312 of the container.

The contact between the seal and the neck for producing the impermeability is radial with respect to the axis of the opening in the container. The level of impermeability obtained in this way is similar to the devices of the preceding examples.

The device comprises a spring member 350 located between the insert 324 and the closing-off element 340 so as to generate a force that tends to push these two elements away from one another. The lower end of the spring member 350 is positioned in abutment against the stop shoulder 343 of the closing-off element 340, and the upper end of the spring member 350 is positioned in abutment against the annular stop 328 of the insert 324.

The way in which this device functions is similar to the way in which the device of the first example functions, and will therefore not be described again here.

The invention is not limited to the examples illustrated. The features of the various examples can in particular be combined as part of variants which are not illustrated.

The expression "comprising a" should be understood as meaning "comprising at least one", unless specified to the contrary.

The invention claimed is:

1. A device for packaging a cosmetic product, the device comprising: a container having an opening defined by a neck of the container; a cap for closing the container, the cap comprising:

a cover element, a closing-off element for the opening connected to the cover element, a spring member located between the cover element and the closing-off element, and a locking mechanism for locking the cap on the container, the locking mechanism comprising a means for retaining the cover element on the container and a means for actuating the retaining means so as to selectively enable the cover element to move with respect to the container from a locked position of the cover element to an unlocked position of the cover element in which the cap can be separated freely from the container; and a seal configured to engage with the closing-off element and the neck of the container, the seal being in radial contact with the closing-off element and the neck of the container in the unlocked position of the cap, wherein contact between the seal and the neck of the container when the seal is secured to the closing-off element, and/or between the seal and the closing-off element when the seal is secured to the container, is maintained radially during movement of the cover element from the locked position to the unlocked position.

2. The device according to claim 1, wherein the cover element is moved from the locked position to the unlocked position by moving solely in translation with respect to the container along an axis passing through the opening of said container.

3. The device according to claim 1, wherein the closing-off element is fixed with respect to the container during movement of the cover element from the locked position to the unlocked position.

4. The device according to claim 1, wherein the seal is fixed relative to the closing-off element.

5. The device according to claim 1, wherein the closing-off element comprises an applicator which extends from the cap into the container, and the seal comprises an applicator wiper mounted in a fixed manner on the neck of the container.

6. The device according to claim 1, wherein the neck of the container comprises a catching means that engages with the retaining means of the locking mechanism.

7. The device according to claim 1, wherein the cover element comprises an insert and the retaining means is supported by the insert.

8. The device according to claim 7, wherein the insert comprises a means for limiting a movement path of the cover element with respect to the closing-off element while the cover element passes from the locked position to the unlocked position.

9. The device according to claim 1, wherein the means for actuating comprises a pushbutton configured to move in translation along an axis passing through the opening of the container.

* * * * *

UNITED STATES PATENT AND TRADEMARK OFFICE

CERTIFICATE OF CORRECTION

PATENT NO. : 9,215,922 B2
APPLICATION NO. : 13/992428
DATED : December 22, 2015
INVENTOR(S) : Jean-Francois Delage et al.

It is certified that error appears in the above-identified patent and that said Letters Patent is hereby corrected as shown below:

Title Page, Item 57 Abstract, line 11, remove "VIII" before "means".

Signed and Sealed this
Fifth Day of April, 2016

Michelle K. Lee

Michelle K. Lee
*Director of the United States Patent and Trademark Office*